US005836293A

United States Patent [19]

Osanai

[11] Patent Number: 5,836,293

[45] Date of Patent: Nov. 17, 1998

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi, Japan

[21] Appl. No.: 910,245

[22] Filed: Aug. 13, 1997

[30] Foreign Application Priority Data

Aug. 13, 1996 [JP] Japan ..... 8-213850

[51] Int. Cl.[6] ..... F02D 41/00

[52] U.S. Cl. ..... 123/698

[58] Field of Search ..... 123/698, 674, 123/520, 519

[56] References Cited

U.S. PATENT DOCUMENTS

| | | | |
|---|---|---|---|
| 5,685,285 | 11/1997 | Ohtani et al. | 123/698 |
| 5,694,911 | 12/1997 | Kawamoto et al. | 123/674 |
| 5,727,537 | 3/1998 | Nakagawa et al. | 123/698 |
| 5,735,255 | 4/1998 | Farmer et al. | 123/698 |

FOREIGN PATENT DOCUMENTS

| | | | |
|---|---|---|---|
| 63-189665 A | 8/1988 | Japan | 123/698 |
| 4370359 A | 12/1992 | Japan | 123/698 |
| 5223021 A | 8/1993 | Japan | 123/698 |
| 7269419 A | 10/1995 | Japan | 123/698 |
| 579410A | 3/1998 | Japan | 123/698 |

*Primary Examiner*—Raymond A. Nelli
*Attorney, Agent, or Firm*—Kenyon & Kenyon

[57] ABSTRACT

An evaporated fuel treatment device comprising a purge control valve for controlling an amount of fuel vapor fed into the intake passage from a charcoal canister. The purge action of the fuel vapor is temporarily stopped and then restarted. The purge action is restarted by the purge rate of just before the purge action was stopped when the engine load at the time of the restart of the purge action is higher than a predetermined set load, while the purge action is restarted by a purge rate lower than a predetermined purge rate when the engine load at the time of the restart of the purge action is lower than the set load.

17 Claims, 20 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

In an internal combustion engine designed to have the evaporated fuel produced in the fuel tank etc. adsorbed once by activated carbon in a canister and to have the evaporated fuel adsorbed by the activated carbon purged in the engine intake passage, it is necessary to purge the evaporated fuel adsorbed by the activated carbon into the intake passage as fast as possible so as to keep the adsorption capacity of the activated carbon from becoming saturated. During engine operation, however, there is the problem that when the purge action is stopped once and then restarted in a state where a large amount of evaporated fuel is adsorbed by the activated carbon, if the purge rate is increased for purging the evaporated fuel from the activated carbon to the inside of the intake passage as fast as possible, a large amount of evaporated fuel will be purged into the intake passage the instant that the purge action is restarted, so the air-fuel ratio will fluctuate by a large margin.

Therefore, there is known an internal combustion engine designed so that when a large amount of evaporated fuel has been adsorbed by the activated carbon while the purge action is stopped, that is, when the purge vapor concentration just before the purge action is stopped is high, the purge rate at the time of the restart of the purge action is made small and when the purge vapor concentration just before the purge action is stopped is low, the purge rate at the time of restart of the purge action is made large (see Japanese Unexamined Patent Publication (Kokai) No. 5-223021).

The amount of the evaporated fuel adsorbed by the activated carbon just before the purge action is stopped and the amount of evaporated fuel adsorbed by the activated carbon when the purge action is restarted, however, are not necessarily the same. When the fuel tank becomes high in temperature and a large amount of evaporated fuel is produced, a large amount of evaporated fuel is adsorbed by the activated carbon in the time from when the purge action is stopped to when the purge action is restarted. Therefore, if the purge rate is increased at the time of the restart of the purge action just because the purge vapor concentration was low just before the purge action was stopped as in the above internal combustion engine, a large amount of evaporated fuel will be purged into the intake passage the instant the purge action is restarted and therefore the problem will arise of a large fluctuation of the air-fuel ratio.

SUMMARY OF THE INVENTION

An object of the present invention is to provide an evaporated fuel treatment device capable of preventing an air-fuel ratio from fluctuating when the purge operation is started.

According to the present invention, there is provided an evaporated fuel treatment device for an engine provided with an intake passage, comprising a purge control valve for controlling an amount of purge of fuel vapor to be purged to the intake passage; purge control means for restarting the purge of the fuel vapor after the purge of the fuel vapor is stopped once during engine operation; and restart purge rate setting means for restarting the purge action by the purge rate just before the purge action was stopped when a load of the engine at the time of the restart of the purge action is higher than a predetermined set load and restarting the purge action by a purge rate below the predetermined purge rate when the load of the engine at the time of the restart of the purge action is lower than the predetermined set load.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
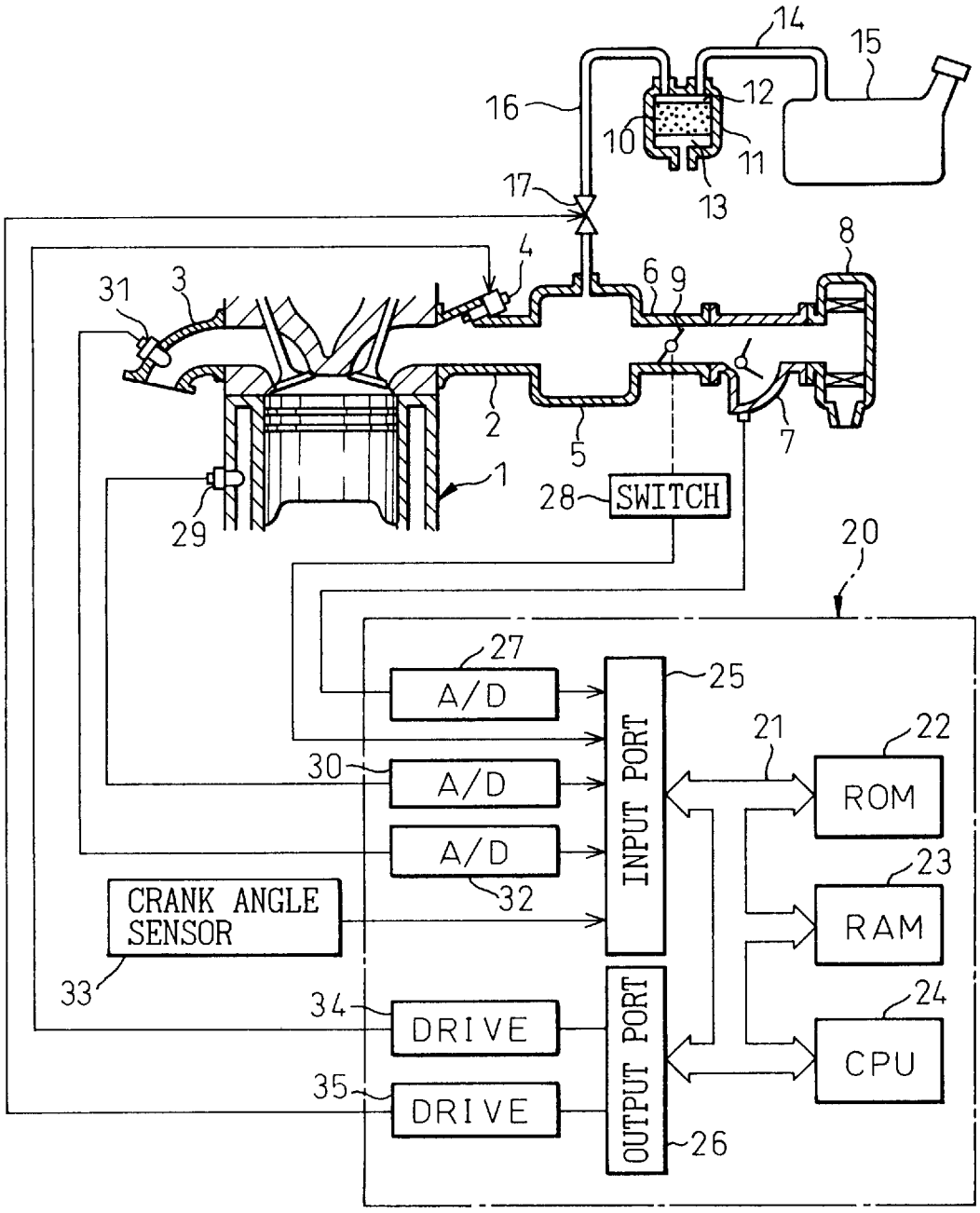
FIG. 1 is an overall view of an internal combustion engine.

Referring to FIG. 1, 1 is an engine body, 2 an intake tube, 3 an exhaust manifold, and 4 a fuel injector attached to each of the intake pipes 2. Each intake pipe 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM 22 as a function of the engine load Q/N (amount of intake air Q/engine speed N) and the engine speed N.

The correction coefficient K expresses the engine warmup increase coefficient and the acceleration increase coefficient all together. When no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9V when the air-fuel ratio is rich and generates an output voltage of about 0.1V when the air-fuel ratio is lean. First, an explanation will be made of the control of the feedback correction coefficient FAF performed based on the output signal of this $O_2$ sensor 31.

Figure 2:
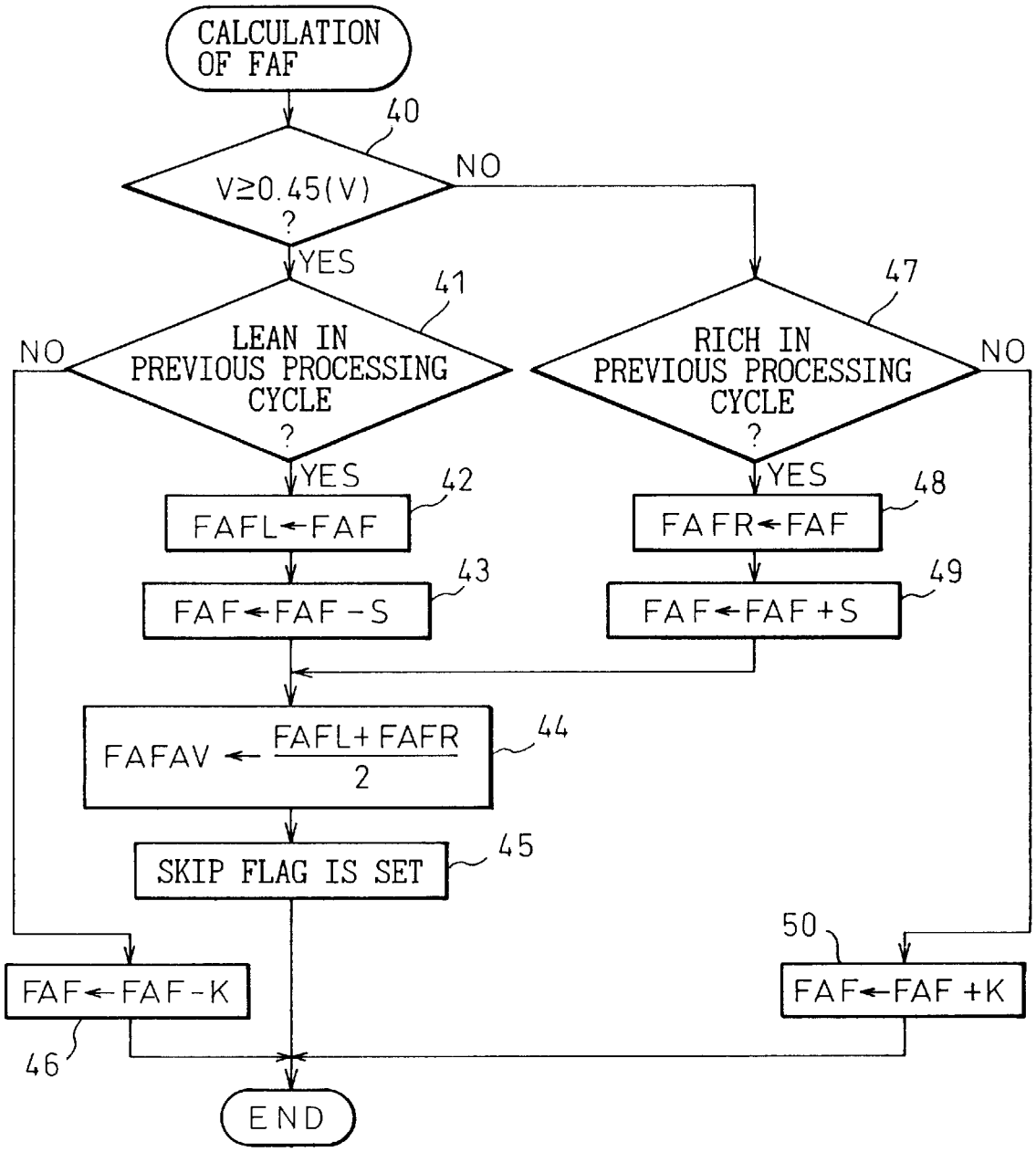
FIG. 2 is a flow chart of a routine for calculating an air-fuel ratio feedback correction coefficient FAF.

FIG. 2 shows the routine for calculation of the feedback correction coefficient FAF. This routine is executed for example within a main routine.

Figure 3:
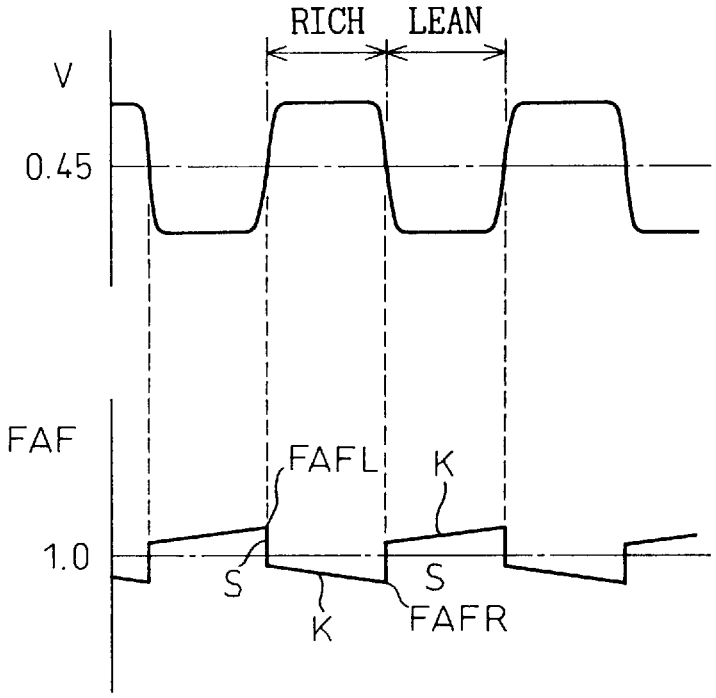
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45V or not, that is, whether the air-fuel ratio is rich or not. When $V \geqq 0.45V$, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip value S is subtracted from the feedback control coefficient FAF, therefore, as shown in FIG. 3, the feedback control coefficient FAF is rapidly reduced by the skip value S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K ($K<<S$) is subtracted from the feedback control coefficient FAF. Therefore, as shown in FIG. 3, the feedback control coefficient FAF is gradually reduced.

On the other hand, when it is judged at step 40 that $V<0.45V$, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

Figure 4:
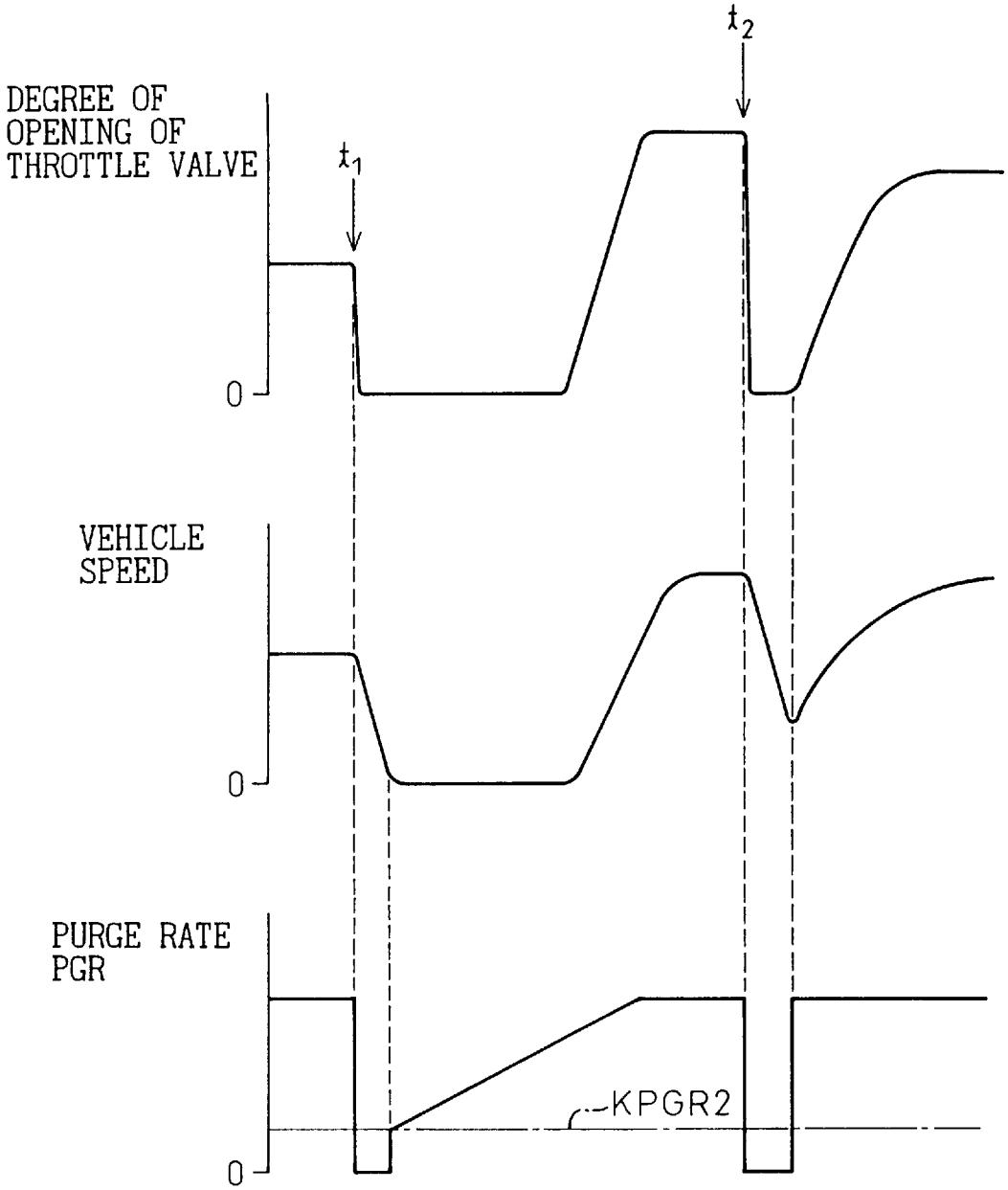
FIG. 4 is a time chart of changes in the purge rate PGR etc.

Next, an explanation will be made of the purge control according to the present invention with reference to FIG. 4 to FIG. 5; FIG. 4 shows the relationship among the throttle opening degree, the vehicle speed, and the purge rate PGR of the fuel vapor in the intake passage.

In this embodiment of the present invention, the supply of fuel is stopped during engine deceleration. When the supply of fuel is stopped, the action of purging the fuel vapor into the intake passage is stopped. In FIG. 4, the time $t_1$ shows when the deceleration operation has been started, therefore at this time the purge rate PGR is made zero. Next, when the fuel injection is restarted and the engine load at that time is lower than a predetermined set load, for example, when the engine is idling at that time, the purge action is restarted by a predetermined purge rate KPGR2. Next, the purge rate PGR is gradually increased. When a predetermined maximum purge rate is reached, the purge rate PGR is held at that maximum purge rate.

Next, assuming that at the time $t_2$ the deceleration operation is started once again, the purge rate PGR is made zero, therefore the purge action is stopped. Next, when an acceleration action is started while the engine is decelerating, the fuel injection is restarted and at the same time the purge action of the fuel vapor is restarted. The engine load at this time is relatively high. When the engine load is relatively high in this way, when the purge action is restarted, the purge rate PGR at the time of restart of the purge action is made the purge rate PGR just before the purge action was stopped. That is, when the purge rate PGR just before the purge action was stopped is higher than the predetermined purge rate KPGR2, if the engine load at the time of restart of the purge action is low, the purge rate PGR at the time of restart of the purge action will be made the predetermined purge rate KPGR2, while if the engine load at the time of restart of the purge action is high, the purge rate at the time of restart of the purge action will be made the purge rate just before the purge action was stopped.

Figure 5:
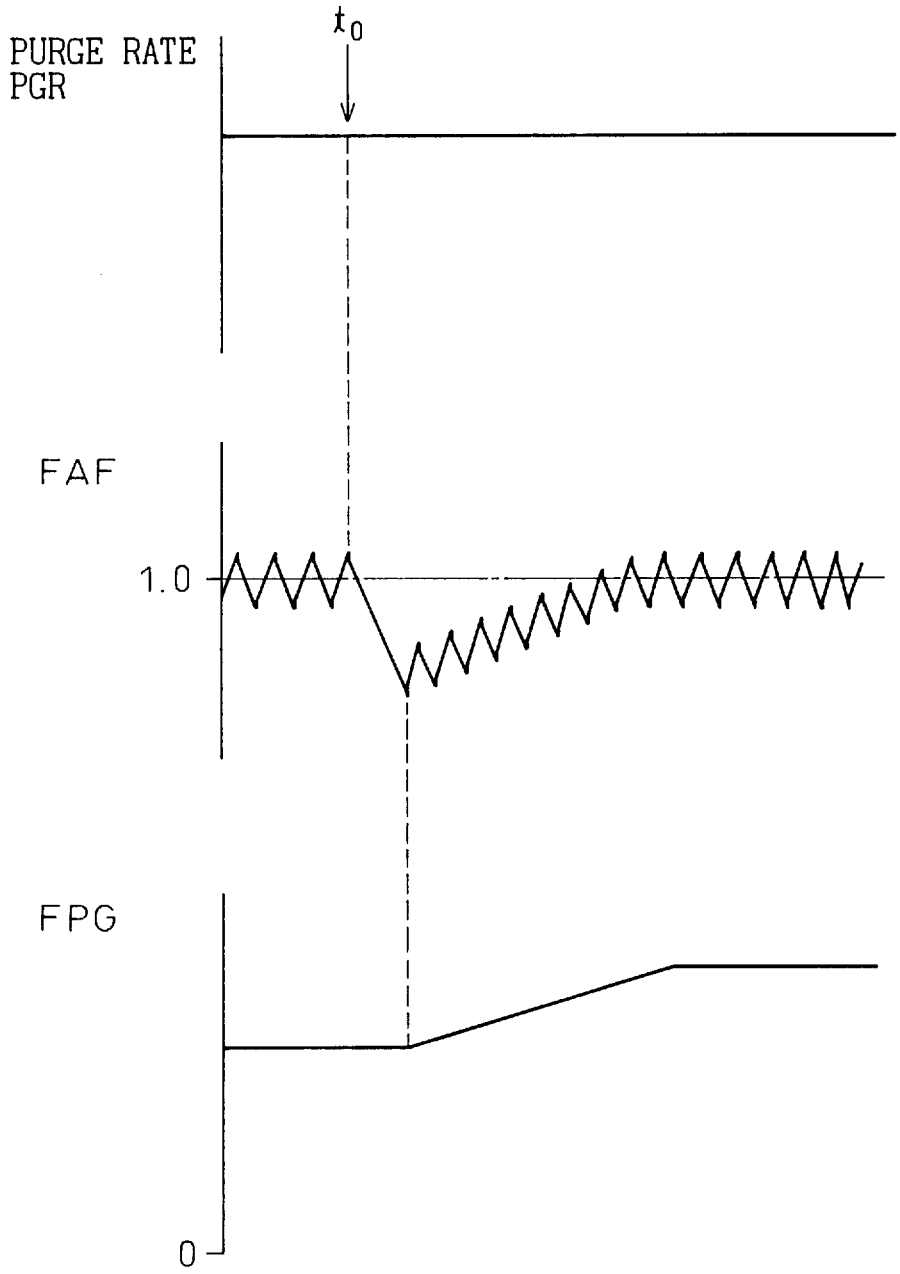
FIG. 5 is a time chart of changes in the purge rate PGR etc.

FIG. 5 shows the changes in the feedback correction coefficient FAF and the purge A/F correction coefficient FPG when the concentration of the fuel vapor to be purged at the time to becomes high and as a result the air-fuel ratio becomes rich. If the air-fuel ratio becomes rich, then as shown in FIG. 5, the feedback correction coefficient FAF becomes small. Next, when the feedback correction coefficient FAF starts to rise, that is, when the air-fuel ratio is held at the stoichiometric air-fuel ratio, the purge A/F correction coefficient FPG is gradually increased and along with this FAF is gradually returned to 1.0. Next, when FAF starts to fluctuate around 1.0, the purge A/F correction coefficient FPG is maintained substantially constant. The value of the purge A/F correction coefficient FPG at this time expresses the amount of fluctuation of the air-fuel ratio by the purge action of the fuel vapor.

If this purge A/F correction coefficient FPG is used to correct the fuel injection time TAU at the time when the purge action is being performed, the air-fuel ratio will not fluctuate so long as the concentration of the fuel vapor to be purged does not change sharply. Therefore, in this embodiment of the present invention, when the purge action is restarted after the purge action has once been stopped, the purge rate PGR at the time of restart of the purge action is in principle made the purge rate of just before the purge action was stopped.

If, however, a large amount of evaporated fuel is adsorbed by the activated carbon 10 of the canister 11 while the purge action was stopped, the concentration of the fuel vapor to be purged will greatly vary from after the restart of the purge action and just before the purge action was stopped. In this case, the effect of a large change of the concentration of the fuel vapor on the air-fuel ratio will become greater the smaller the amount of intake air, therefore to prevent a fluctuation of the air-fuel ratio when the amount of intake air is small, it is necessary to reduce the amount of purge at the time when the amount of intake air is small.

Therefore, in this embodiment of the present invention, as shown in FIG. 4, when the engine load is low, that is, when the amount of intake air is small, when the purge action is restarted, the purge rate PGR at the time of restart is made the predetermined purge rate KPGR2. If the maximum purge rate is made 8 percent, the predetermined purge rate PGR is a small value of about 2 percent. This predetermined purge rate KPGR2 is called the minimum purge rate at this time.

Next, an explanation will be made of a routine for control of the purge with reference to FIG. 6 to FIG. 8. Note that this routine is executed by interruption every predetermined time.

Figure 6:
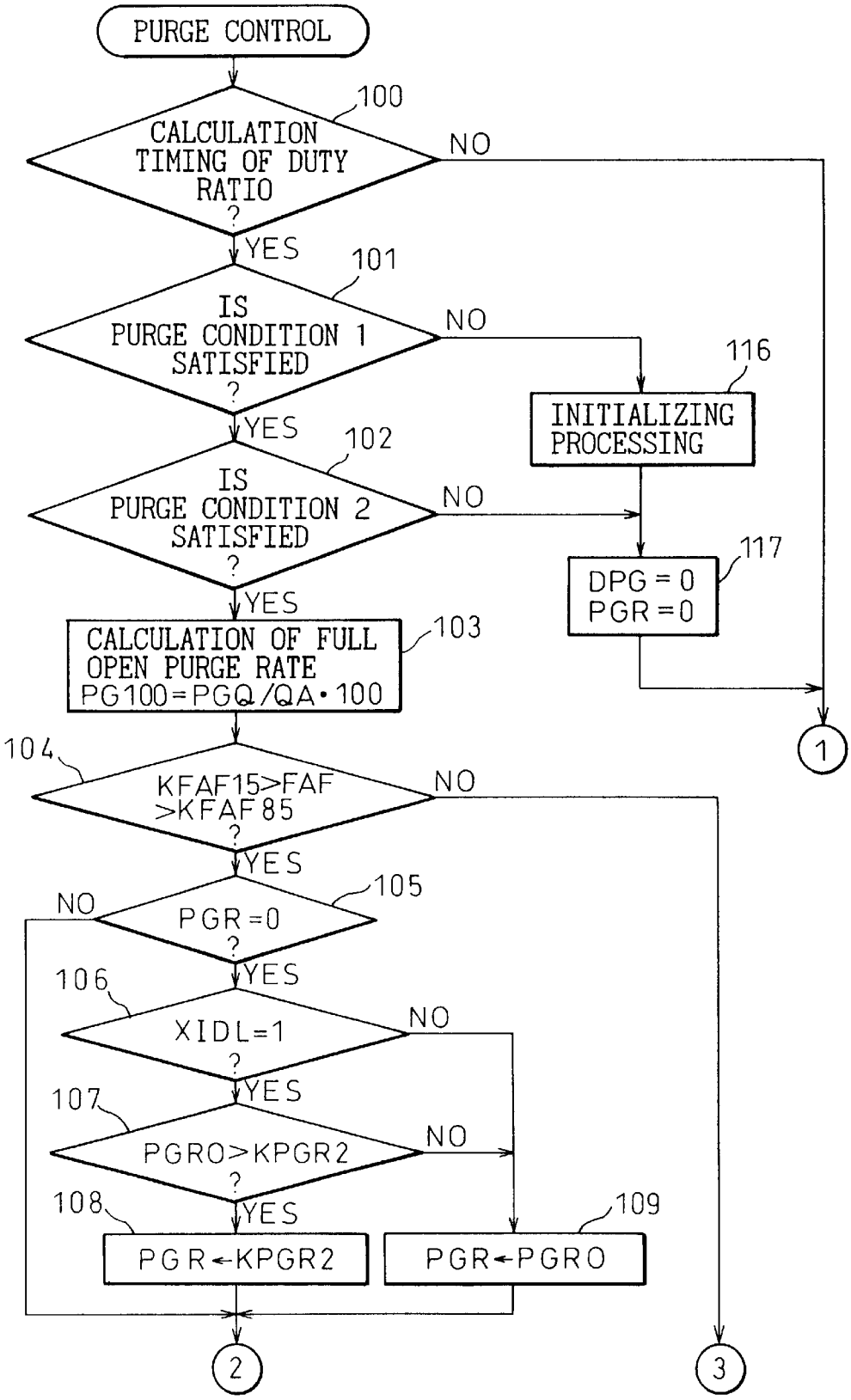
FIGS. 6 and 7 are flow charts of a first embodiment for the purge control.
Figure 7:
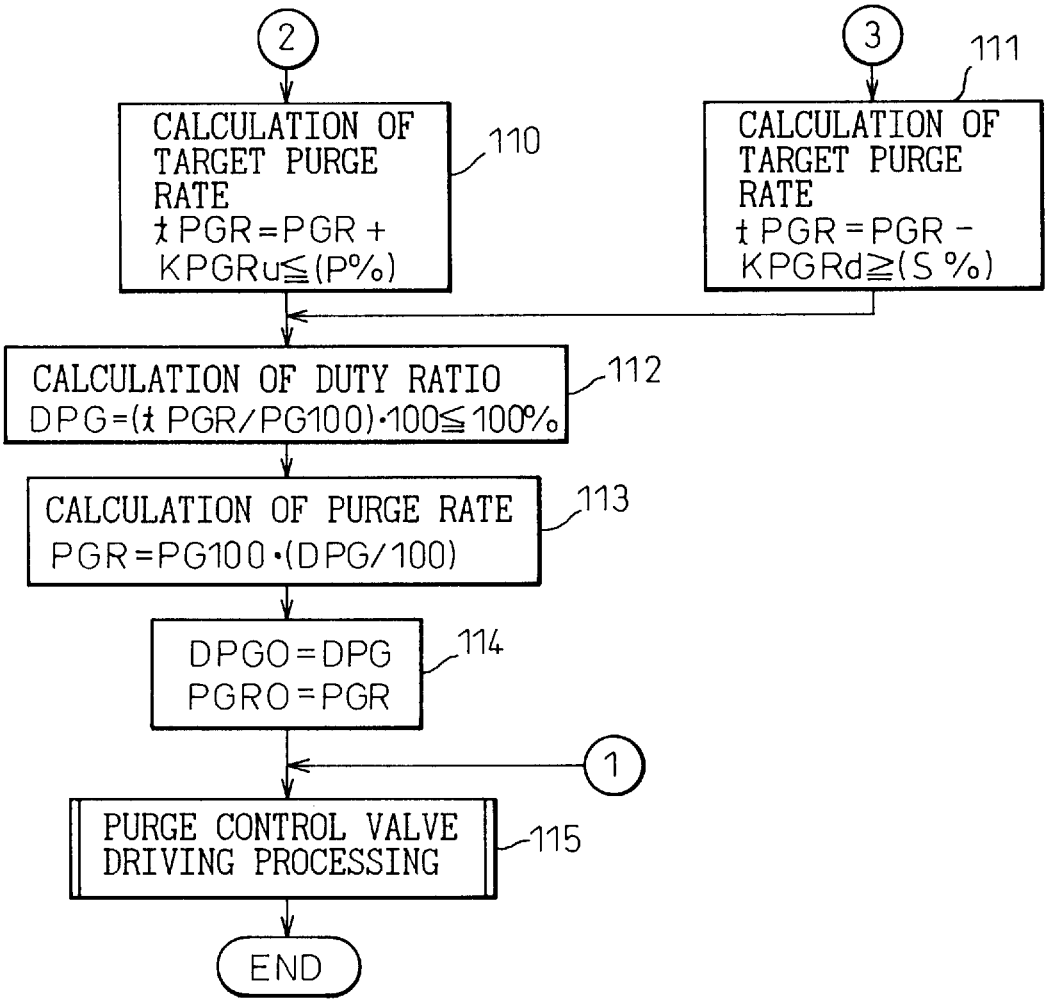

Referring to FIG. 6 and FIG. 7, first, at step 100, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 115, where the processing for driving the purge control valve 17 is executed. As opposed to this, when it is the time for calculation of the duty ratio, the routine proceeds to step 101, where it is judged if the purge condition 1 is satisfied or not, for example, if the engine warmup has been completed or not. When the purge condition 1 is not satisfied, the routine proceeds to step 116, where the initialization processing is performed, then at step 117, the duty ratio DPG and the purge rate PGR are made zero. As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 117, while when the purge condition 2 is satisfied, the routine proceeds to step 103.

At step 103, the ratio between the full open purge amount PGQ and the amount QA of intake air, that is, the full open purge rate PG100 (=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so as shown in Table 1, the full open purge rate PG100 becomes larger the lower the engine load Q/N becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 105, where it is judged whether the purge rate PGR is zero or not. That is, when the purge action is being performed, PGR>0, so at this time the routine jumps to step 110. As opposed to this, when PGR=0, that is, the purge action is not performed, the routine proceeds to step 106.

At step 106, it is judged if the idling flag XIDL, which is set when the engine operating state is an idling state, has been reset (XIDL=0) or not. When the idling flag XIDL is reset (XIDL=0), that is, when the engine is not idling, the routine jumps to step 109, where the purge rate PGR0 just before the purge action was stopped is made the restart purge rate PGR. Next, the routine proceeds to step 110.

On the other hand, when it is judged at step 106 that the idling flag XIDL has been set, that is, when the engine is idling, the routine proceeds to step 107, where it is judged if the purge rate PGR0 just before the purge action was stopped is larger than the minimum purge rate KPGR2 or not. When PGRO≦KPGR2, the routine proceeds to step 109, where the purge rate PGR just before the purge action was stopped is made the restart purge rate PGR. As opposed to this, when it is judged at step 107 that PGR0>KPGR2, the routine proceeds to step 108, where the minimum purge rate KPGR2 is made the restart purge rate PGR, then the routine proceeds to step 110. That is, even when the purge rate PGR0 just before the purge action was stopped is larger than the minimum purge rate KPGR2, when the purge action is started while the engine is idling, the minimum purge rate KPGR2 is made the restart purge rate PGR.

At step 110, the target purge rate tPGR (=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit purge rate is set for this target purge rate tPGR, therefore the target purge rate tPGR can only rise up to this upper limit purge rate. Next, the routine proceeds to step 112.

On the other hand, when it is judged at step 104 that FAF≧KFAF15 or FAF≦KFAF85, the routine proceeds to step 111, where the constant value KPGRd is subtracted from the purge rate PGR to calculate the target purge rate tPGR (=PGR-KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 112.

At step 112, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 113, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 114, the duty ratio DPG is made DPG0 and the purge rate PGR is made PGR0. Next, at step 115, processing is performed to drive the purge control valve 17. This drive processing is shown in FIG. 8, therefore, an explanation will next be made of the drive processing of FIG. 8.

Figure 8:
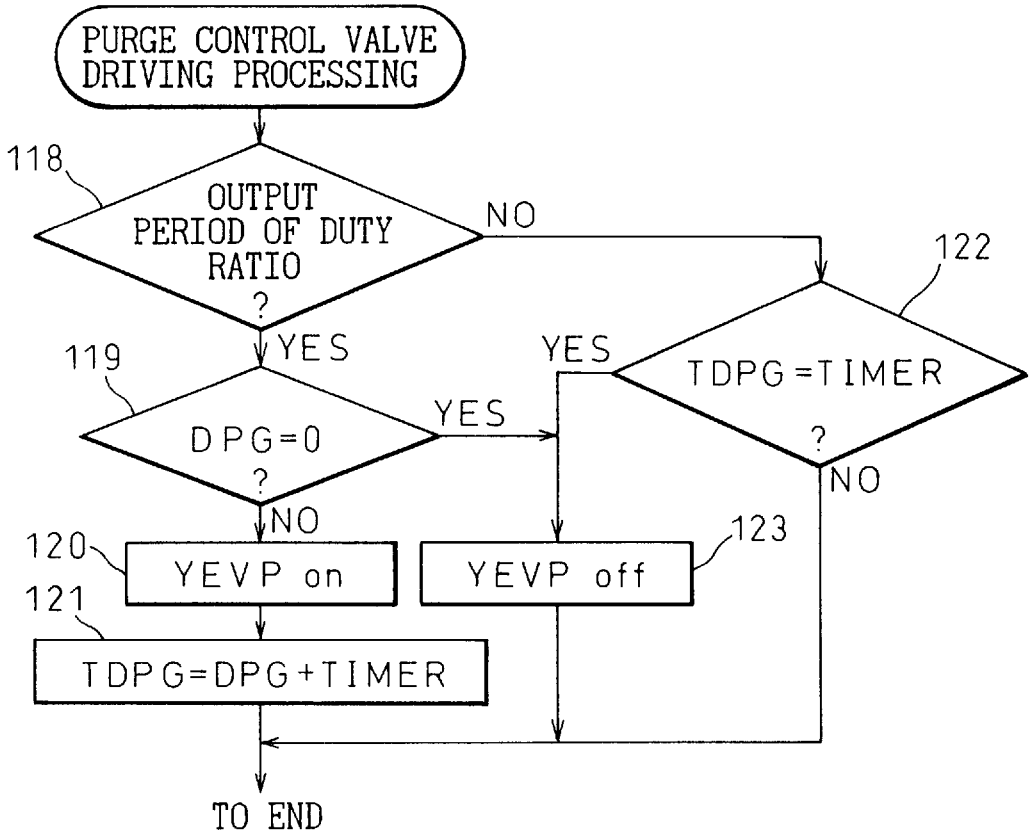
FIG. 8 is a flow chart for the processing for driving the purge control valve.

Referring to FIG. 8, first, at step 118, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 119, where it is judged if the duty ratio DPG is zero or not. When DPG=0, the routine proceeds to step 123, where the drive pulse YEVP of the purge control valve 17 is turned off. As opposed to this, when DPG is not 0, the routine proceeds to step 120, where the drive pulse YEVP of the purge control valve 17 is turned on. Next, at step 121, the duty ratio DPG is added to the current time TIMER to calculate the off time TDPG of the drive pulse (=DPG+TIMER).

On the other hand, when it is judged at step 118 that the output period of the duty ratio has not arrived, the routine proceeds to step 122, where it is judged if the current time TIMER is the off time TDPG of the drive pulse. When TDPG=TIMER, the routine proceeds to step 123, where the drive pulse YEVP is turned off.

Figure 9:
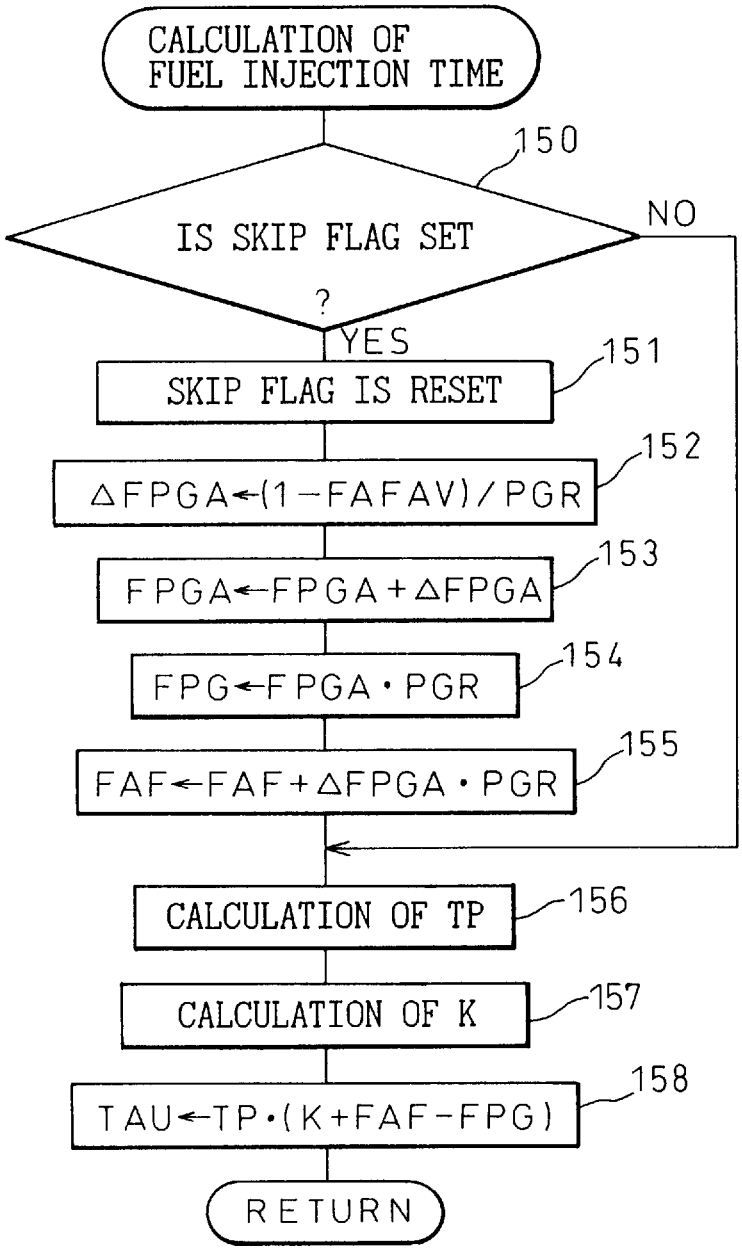
FIG. 9 is a flow chart of the calculation of the fuel injection time.

FIG. 9 shows the routine for calculation of the fuel injection time TAU. This routine is executed repeatedly.

Referring to FIG. 9, first, at step 150, it is judged if the skip flag which is set at step 45 of FIG. 2 has been set or not. When the skip flag has not been set, the routine jumps to step 156. As opposed to this, when the skip flag has been set, the routine proceeds to step 151, where the skip flag is reset, then the routine proceeds to step 152, where the purge vapor concentration ΔFPGA per unit purge rate is calculated based on the following formula:

$$\Delta FPGA=(1-FAFAV)/PGR$$

That is, the amount of fluctuation (1−FAFAV) of the average air-fuel ratio FAFAV shows the purge vapor concentration therefore by dividing (1−FAFAV) by the purge rate PGR, the purge vapor concentration ΔFPGA per unit purge rate is calculated. Next, at step 153, the purge vapor concentration ΔFPGA is added to the purge vapor concentration FPGA to update the purge vapor concentration FPGA per unit purge rate. When FAFAV approaches 1.0, ΔFPGA approaches zero, therefore FPGA approaches a constant value. Next, at step 154, the purge rate PGR is multiplied with FPGA to calculate the purge A/F correction coefficient FPG (=FPGA·PGR). Next, at step 155, ΔFPGA·PGR is added to FAF so as to increase the feedback control coefficient FAF by exactly the amount of the increase of the purge A/F correction coefficient FPG. Next, at step 156, the basic fuel injection time TP is calculated, then at step 157, the correction coefficient K is calculated, then at step 158, the injection time TAU (=TP·(k+FAF=FPG)) is calculated.

Figure 10:
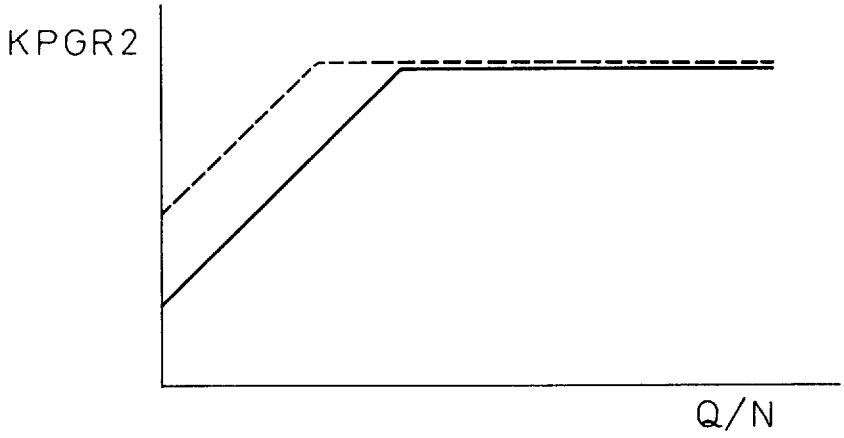
FIG. 10 is a view of a minimum purge rate KPGR2.
Figure 11:
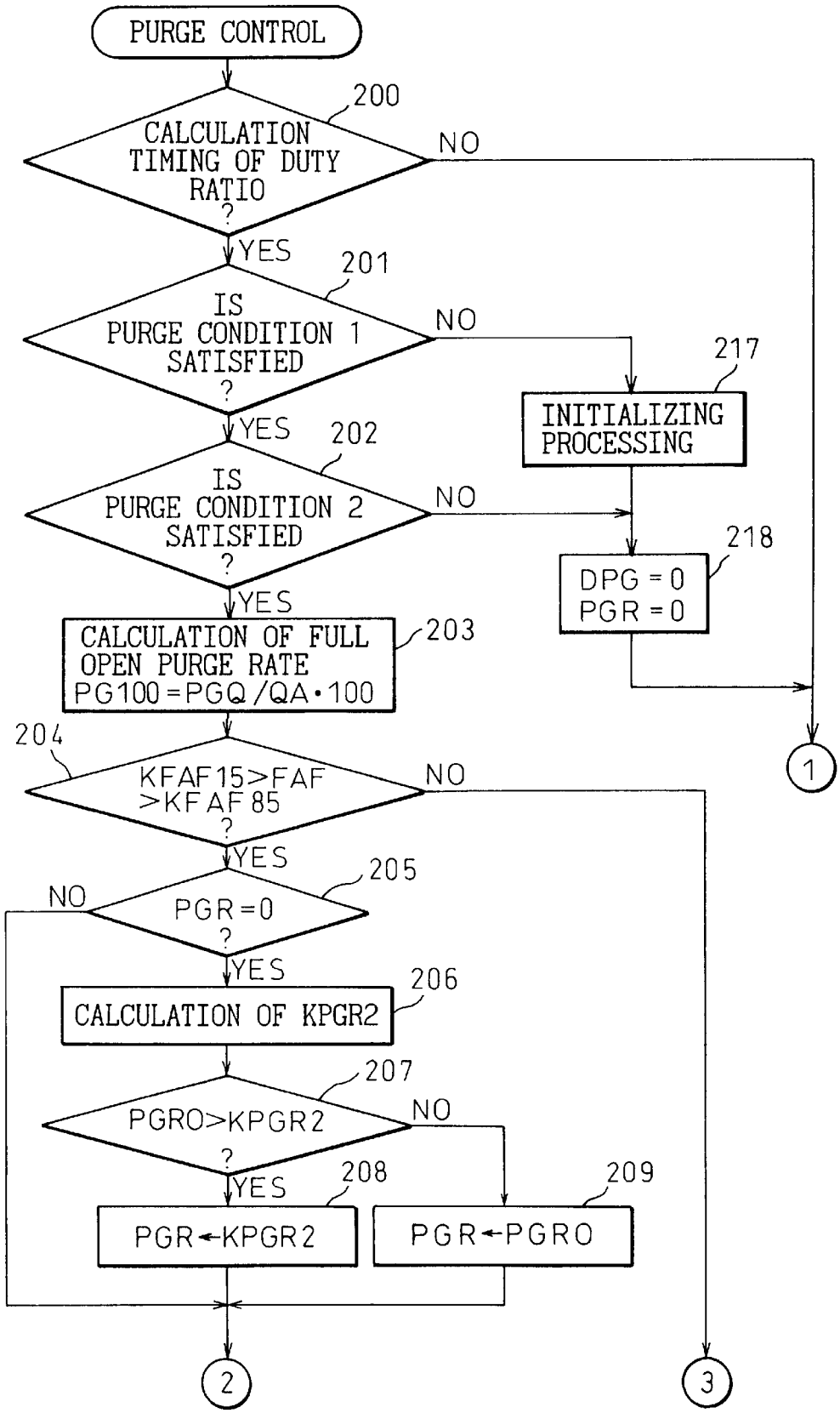
FIGS. 11 and 12 are flow charts of a second embodiment for the purge control.
Figure 12:
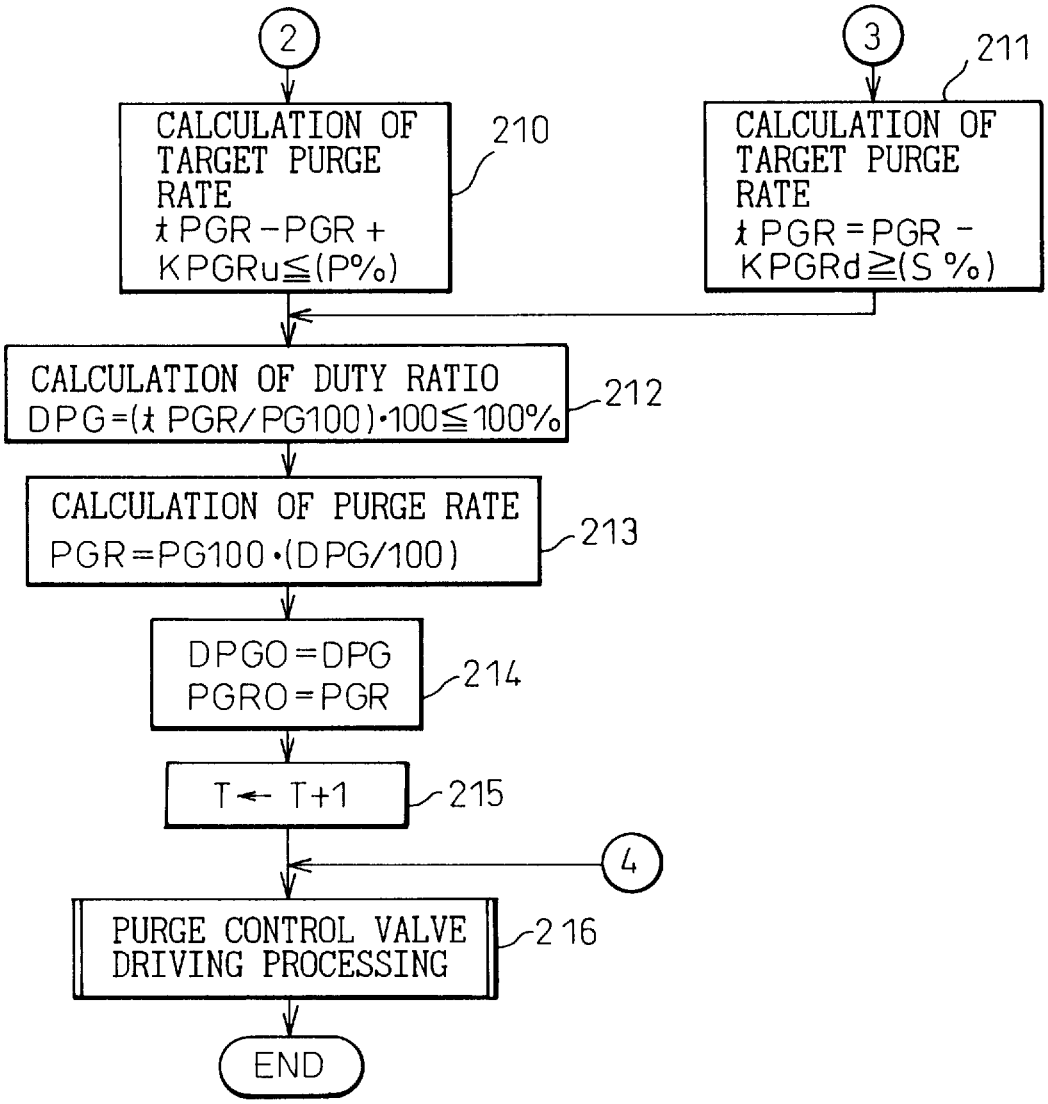

A second embodiment is shown in FIG. 10 to FIG. 12. In this embodiment, as shown in FIG. 10, the minimum purge rate KPGR2 is determined based on the engine load Q/N at the time of restart of the purge action and the time of execution of the purge action after the start of engine operation. Note that in FIG. 10, the solid line shows the case of a long time of execution of the purge action, while the broken line shows the case of a short time of execution of the purge action. When the time of execution of the purge action is long, the amount of evaporated fuel adsorbed into the activated carbon 10 is smaller than in the case where it is large. The smaller the amount of evaporated fuel adsorbed by the activated carbon 10, the greater the amount of evaporated fuel adsorbed by the activated carbon 10 while the purge action is stopped. Therefore, when the time of execution of the purge action is long, the difference between the concentration of the purge vapor just before the purge action is stopped at the concentration of the purge vapor at the time of restart of the purge action becomes greater than compared with when it is short.

The larger the difference of concentration of the purge vapor, the greater the fluctuation of the air-fuel ratio when the purge action is restarted. Therefore, as shown in FIG. 10, when the time of execution of the purge action is long (solid line in FIG. 10), the minimum purge rate KPGR2 is made smaller than when it is short (broken line of FIG. 10). Further, the smaller then engine load Q/N at the time of restart of the purge action, that is, the smaller then amount of intake air, the greater the effect the fuel vapor has on the air-fuel ratio. Therefore, as shown in FIG. 10, the minimum purge rate KPGR2 is made smaller then lower the engine load Q/N. Note that the minimum purge rate KPGR2 may be determined based on the amount of intake air Q instead of the engine load Q/N. In this case, the horizontal axis of FIG. 10 may be made Q.

A routine for control of the purge action is shown in FIG. 10 and FIG. 11.

Referring to FIG. 10 and FIG. 11, first, at step 200, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 216, where the processing for driving the purge control valve 17 is executed. As opposed to this, when it is the time for calculation of the duty ratio, the routine proceeds to step 201, where it is judged if the purge condition 1 is satisfied or not, for example, if the engine warmup has been completed or not. When the purge condition 1 is not satisfied, the routine proceeds to step 217, where the initialization processing is performed, then at step 218, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 218, while when the purge condition 2 is satisfied, the routine proceeds to step 203.

At step 203, the ratio between the full open purge amount PGQ and the amount QA of intake air, that is, the full open purge rate PG100 (=(PGQ/QA)·100) is calculated. Next, at step 204, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 205, where it is judged whether the purge rate PGR is zero or not. That is, when the purge action is being performed, PGR>0, so at this time the routine jumps to step 210. As opposed to this, when the purge action has not started, the routine proceeds to step 206, where it is judged if the pressure PCN in the fuel vapor chamber 12 is higher than the set value KPCNO based on the output signal of a pressure sensor 40.

At step 207, it is judged if the purge rate PGR0 of just before the purge action was stopped is larger than the minimum purge rate KPGR2 or not. When PGR0≦KPGR2, the routine proceeds to step 209, where the purge rate PGR0 of just before the purge action was stopped is made the restart purge rate PGR, then the routine proceeds to step 210.

As opposed to this, when it is judged at step 207 that PGR0>KPGR2, the routine proceeds to step 208, where the minimum purge rate KPGR2 is made the restart purge rate PGR, then the routine proceeds to step 210. That is, even when the purge rate PGR0 just before the purge action was stopped is larger than the minimum purge rate KPGR2, the minimum purge rate KPGR2 is made the restart purge rate PGR.

At step 210, the constant value KPGRu is added to the purge rate PGR to calculate the target purge rate tPGR (=PGR+KPGRu), then the routine proceeds to step 212. On the other hand, when it is judged at step 204 that FAF≧KFAF15 or FAF≦KFAF85, the routine proceeds to step 211, where the constant value KPGRd is subtracted from the purge rate PGR to calculate the target purge rate tPGR (=PGR−KPGRd). Next, the routine proceeds to step 212.

At step 212, the target purge rate tPGR is divided by the full open purge rate PG100 to calculate the duty ratio DPG (=(tPGR/PG100)·100) of the drive pulse of the purge control valve 17. Next, at step 213, the duty ratio DPG is multiplied with the full open purge rate PG100 to calculate the actual purge rate PGR (=PG100·(DPG/100)). Next, at step 214, the duty ratio DPG is made DPG0 and the purge rate PGR is made PGR0. Next, at step 215, the processing for driving the purge control valve 17 shown in FIG. 11 is performed. Next, at step 216, where processing is performed to drive the purge control valve 17 as shown in FIG. 8.

Figure 13:
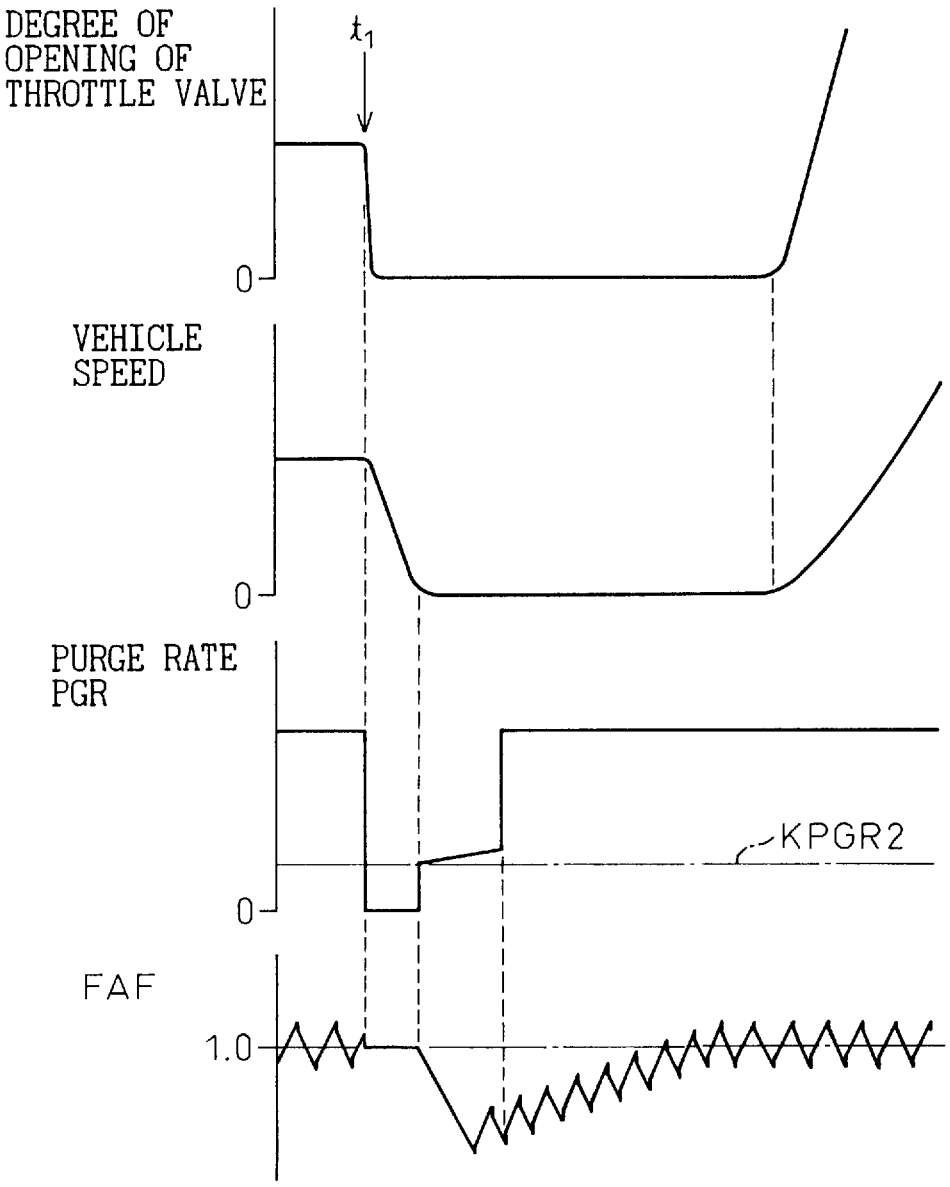
FIG. 13 is a time chart of a third embodiment showing changes in the purge rate etc.

A third embodiment is shown in FIG. 13 to FIG. 16. FIG. 13 shows the relationship between the throttle opening degree, the vehicle speed, the purge rate PGR, and the feedback correction coefficient FAF at the time $t_1$ of a deceleration operation when the supply of fuel is stopped. In this embodiment, when the engine load is low, for example, when the engine is idling, if the purge action is restarted, the purge rate PGR is gradually increased from the minimum purge rate KPGR2. However, in this embodiment, fluctuations of the air-fuel ratio are further suppressed by slowing the rate of increase of the purge rate PGR compared with the case shown in FIG. 4. Further, in this embodiment, if the skip action (S in FIG. 3) of the feedback correction coefficient FAF after restart of the purge action reaches three, the purge rate PGR is increased all at once to the purge rate of just before the purge action was stopped so as to purge the fuel vapor as quickly as possible from the activated carbon 10. That is, when the number of skip actions of the feedback correction coefficient FAF is performed three times or so, the air-fuel ratio is held stably at the stoichiometric air-fuel ratio. If the air-fuel ratio stabilizers in this way, even if the purge rate PGR is rapidly changed, the air-fuel ratio will not change that much. Therefore in this embodiment, when the air-fuel ratio is stabilized after restart of the purge action, the purge rate PGR is increased all at once.

Figure 14:
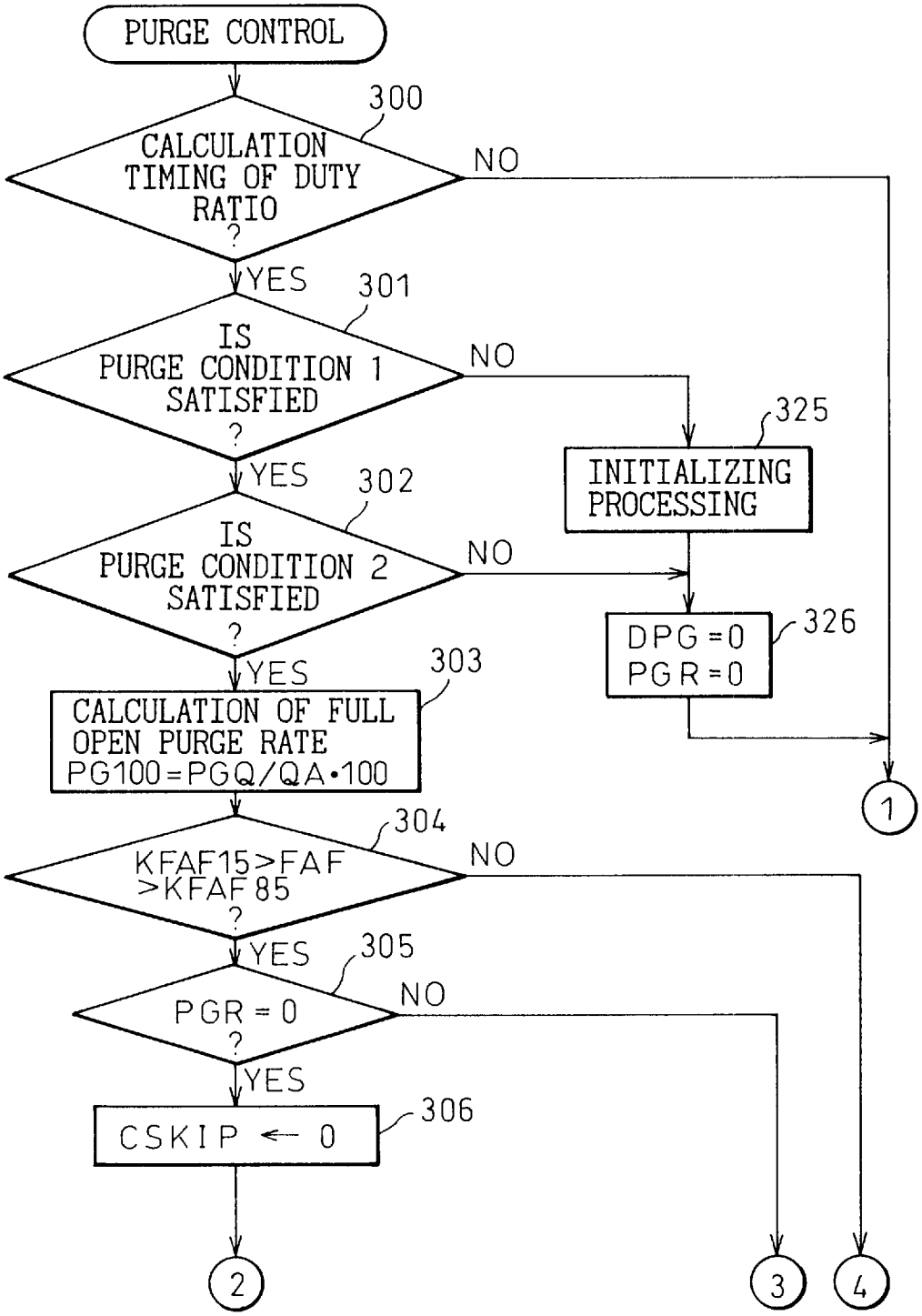
FIGS. 14 to 16 are flow charts of a third embodiment for the purge control.
Figure 15:
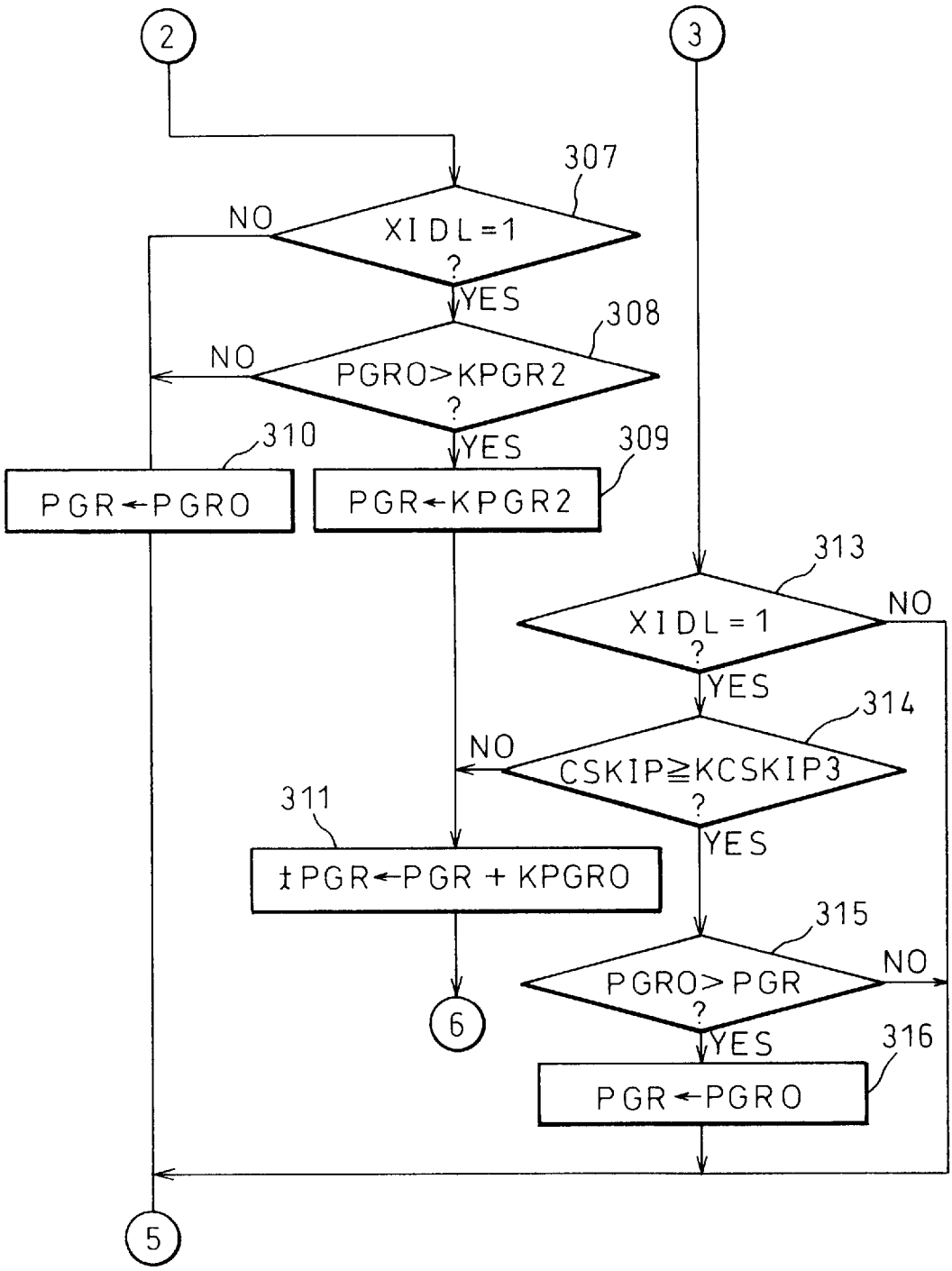
Figure 16:
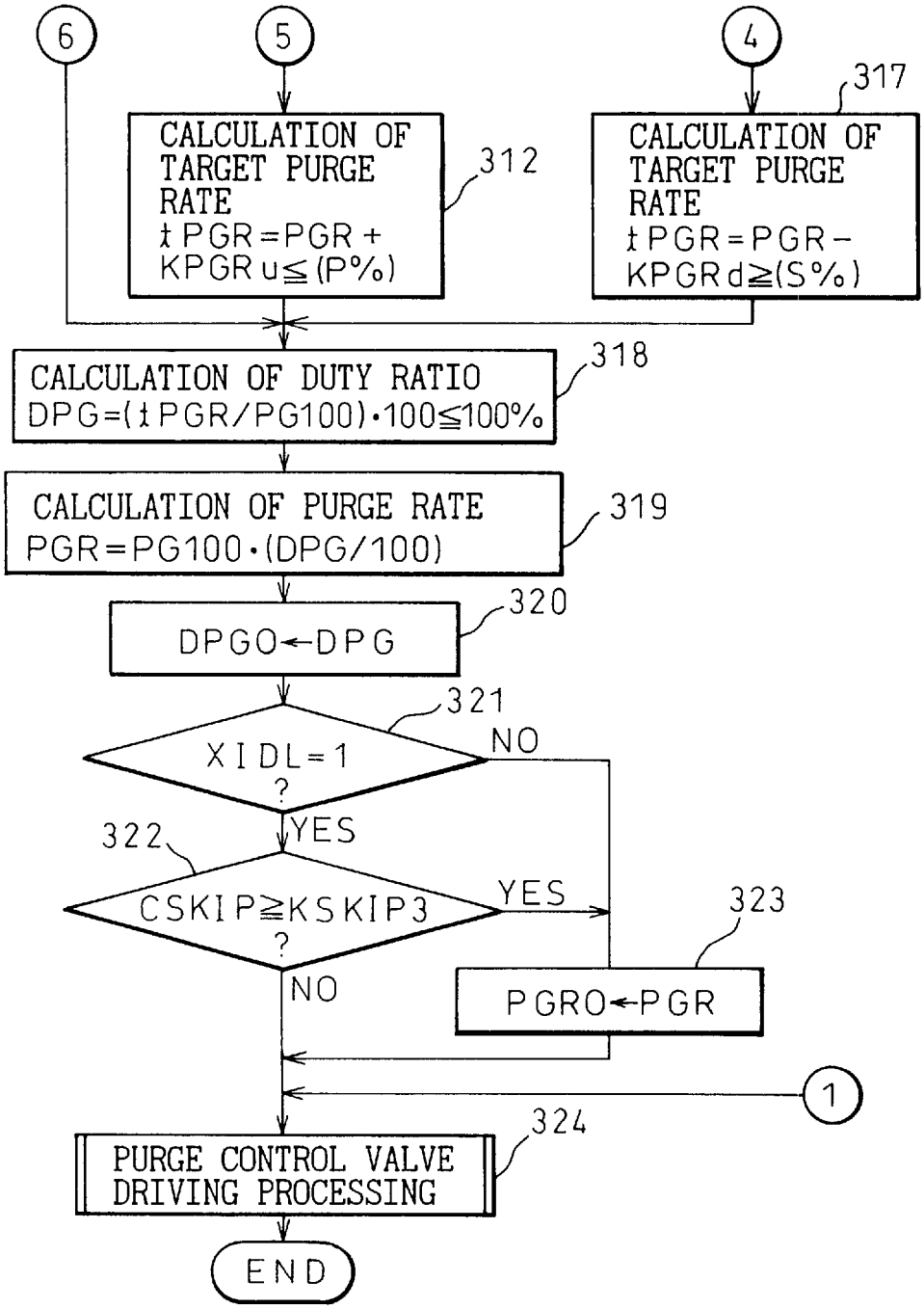

FIG. 14 to FIG. 16 show a routine for control of a purge action.

Referring to FIG. 14 to FIG. 16, first, at step 300, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 324, where the processing for driving the purge control valve 17 is executed. As opposed to this, when it is the time for calculation of the duty ratio, the routine proceeds to step 301, where it is judged if the purge condition 1 is satisfied or not, for example, if the engine warmup has been completed or not. When the purge condition 1 is not satisfied, the routine proceeds to step 325, where the initialization processing is performed, then at step 326, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 326, while when the purge condition 2 is satisfied, the routine proceeds to step 303.

At step 303, the ratio between the full open purge amount PGQ and the amount QA of intake air, that is, the full open purge rate PG100 (=(PGQ/QA)·100) is calculated. Next, at step 304, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 305, where it is judged whether the purge rate PGR is zero or not. When PGR=0, that is, when no purge action is being performed, the routine proceeds to step 306. At step 306, the count CSKIP of the number of skips of the feedback correction coefficient FAF is made zero, then the routine proceeds to step 307.

At step 307, it is judged if the idling flag XIDL, which is set when the engine operating state is an idling state, has been set or not. When the idling flag XIDL is reset (XIDL=0), that is, when the engine is not idling, the routine proceeds to step 310, where the purge rate PGR0 just before the purge action was stopped is made the restart purge rate PGR. Next, the routine proceeds to step 312.

On the other hand, when it is judged at step 307 that the idling flag XIDL has been set, that is, when the engine is idling, the routine proceeds to step 308, where it is judged if the purge rate PGR0 just before the purge action was stopped is larger than the minimum purge rate KPGR2 or not. When PGR0<KPGR2, the routine proceeds to step 310, where the purge rate PGR just before the purge action was stopped is made the restart purge rate PGR.

As opposed to this, when it is judged at step 308 that PGR0>KPGR2, the routine proceeds to step 309, where the minimum purge rate KPGR2 is made the restart purge rate PGR, then the routine proceeds to step 311. That is, even when the purge rate PGR0 just before the purge action was stopped is larger than the minimum purge rate KPGR2, when the purge action is started while the engine is idling, the minimum purge rate KPGR2 is made the restart purge rate PGR.

At step 311, the target purge rate tPGR (=PGR+KPRGu) is calculated by adding a set value KPGR0 to the purge rate PGR, then the routine proceeds to step 318. This set value KPGR0 is smaller than the set value KPGRu used for calculation of the target purge rate tPGR at step 312, therefore at step 311, while the target purge rate tPGR is being calculated, the rate of increase of the target purge rate tPGR is slowed.

On the other hand, when it is judged at step 305 that the purge rate PGR is not zero, that is, when the purge action is not being performed, the routine proceeds to step 313, where it is judged if the idling flag XIDL has been set or not. When the idling flag XIDL has been reset, that is, when the engine is not idling, the routine jumps to step 312. As opposed to this, when the idling flag XIDL has been set, that is, when the engine is idling, the routine proceeds to step 314.

At step 314, it is judged if the count CSKIP of the skips is larger than a set number KCSKIP3, for example, three, or not. That is, it is judged if the number of skips of the feedback correction coefficient FAF has exceeded three or not. When CSKIP<KCSKIP3, the routine jumps to step 311. Therefore, until the feedback correction coefficient FAF is skipped three times after restart of a purge action, the target purge rate tPGR is raised at a low speed.

Next, when CSKIP≧KCSKIP3, the routine proceeds to step 315, where it is judged if the purge rate PGR0 just before the purge action was stopped is larger than a current purge rate PGR. When PGR0≦PGR, the routine jumps to step 316, where the purge rate PGR0 just before the purge action was stopped is made the purge rate PGR. Therefore, at this time, the purge rate PGR is increased all at once to the purge rate PGR0. Next, the routine proceeds to step 312.

At step 312, the target purge rate tPGR (=PGR+KPRGu) is calculated by adding a constant value KPGRu to the purge rate PGR. Next, the routine proceeds to step 318. On the other hand, when it is judged at step 304 that FAF>KFAF15 or FAF<KFAF85, the routine proceeds to step 317, where the constant value KPGRd is subtracted from the purge rate PGR to calculate the target purge rate tPGR (=PGR−KPGRd). Next, the routine proceeds to step 318.

At step 318, the target purge rate tPGR is divided by the full open purge rate PG100 to calculate the duty ratio DPG (=(tPGR/PG100)·100) of the drive pulse of the purge control valve 17. Next, at step 319, the full open rate PG100 is multiplied by the duty ratio DPG to calculate the actual purge rate PGR (=PG1·(DPG/100)). Next, at step 320, the duty ratio DPG is made DPG0.

Next, at step 321, it is judged if the idling flag XIDL is set or not. When the idling flag XIDL is reset, the routine proceeds to step 323, where the purge rate PGR is made PGR0. As opposed to this, when the idling flag XIDL is set, the routine proceeds to step 322, where it is judged if the count CSKIP of the skips has exceeded the set value KSKIP3 or not. When CSKIP<KSKIP3, the routine proceeds to step 324, while when CSKIP≧KSKIP3, the routine proceeds to step 323.

That is, when the purge action is restarted while the engine is idling, the value of PGR0 is held at the purge rate of just before the purge action was stopped until the number of skips exceeds three. At step 316, the purge rate PGR0 of just before the purge action was stopped is made the purge rate PGR, then the routine proceeds from step 322 to step 323. Next, at step 324, processing is performed to drive the purge control valve 17 shown in FIG. 8.

Figure 17:
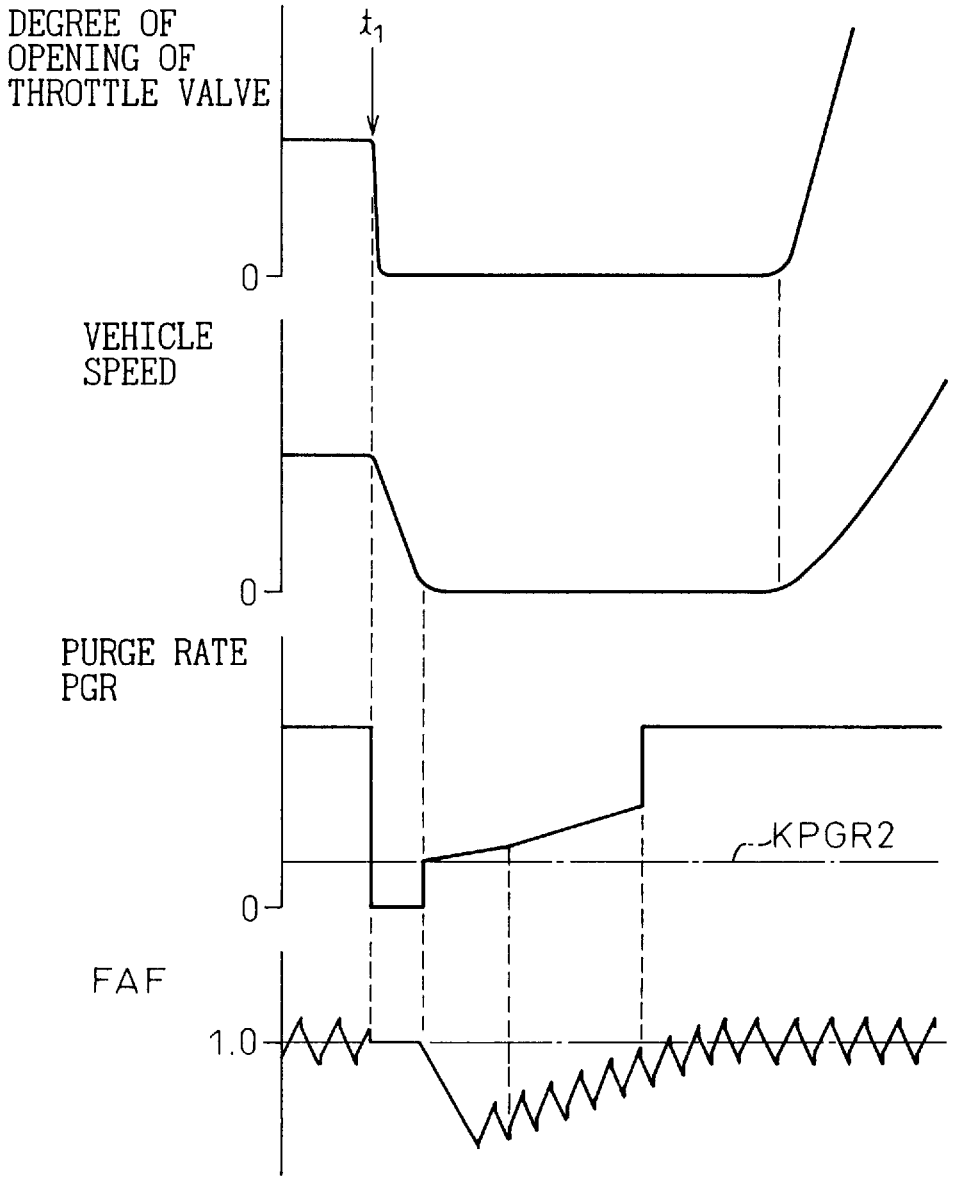
FIG. 17 is a time chart of a fourth embodiment showing changes in the purge rate etc.

A fourth embodiment is shown from FIG. 17 to FIG. 20. FIG. 17, like FIG. 13, shows the changes in the throttle opening degree, the vehicle speed, the purge rate PGR, and the feedback correction coefficient FAF when the engine decelerates at the time $t_1$ and the supply of fuel is stopped. In this embodiment as well, like in the embodiment shown in FIG. 13 to FIG. 16, when the engine load is low, for example, when the engine is idling, if the purge action is restarted, the purge rate PGR is gradually increased from the minimum purge rate KPGR2 and the speed of increase of the purge rate PGR is slowed.

On the other hand, in this embodiment as well, a while after the purge action is restarted, the purge rate PGR is raised all at once to the purge rate PGR0 just before the purge action was stopped so as to purge the fuel vapor from the activated carbon 10 as fast as possible. In this embodiment, however, the purge rate PGR is raised all at once when the feedback correction coefficient FAF has been restored to near 1.0 after the restart of the purge action. That is, when the feedback correction coefficient FAF is restored to near 1.0, the purge A/F correction coefficient FPG stabilizes and becomes substantially constant. At this time, even if the purge rate PGR is made to rapidly change, the air-fuel ratio will not fluctuate that much, so in this embodiment, the purge rate PGR is made to increase all at once when the feedback correction coefficient FAF returns to near 1.0.

Figure 18:
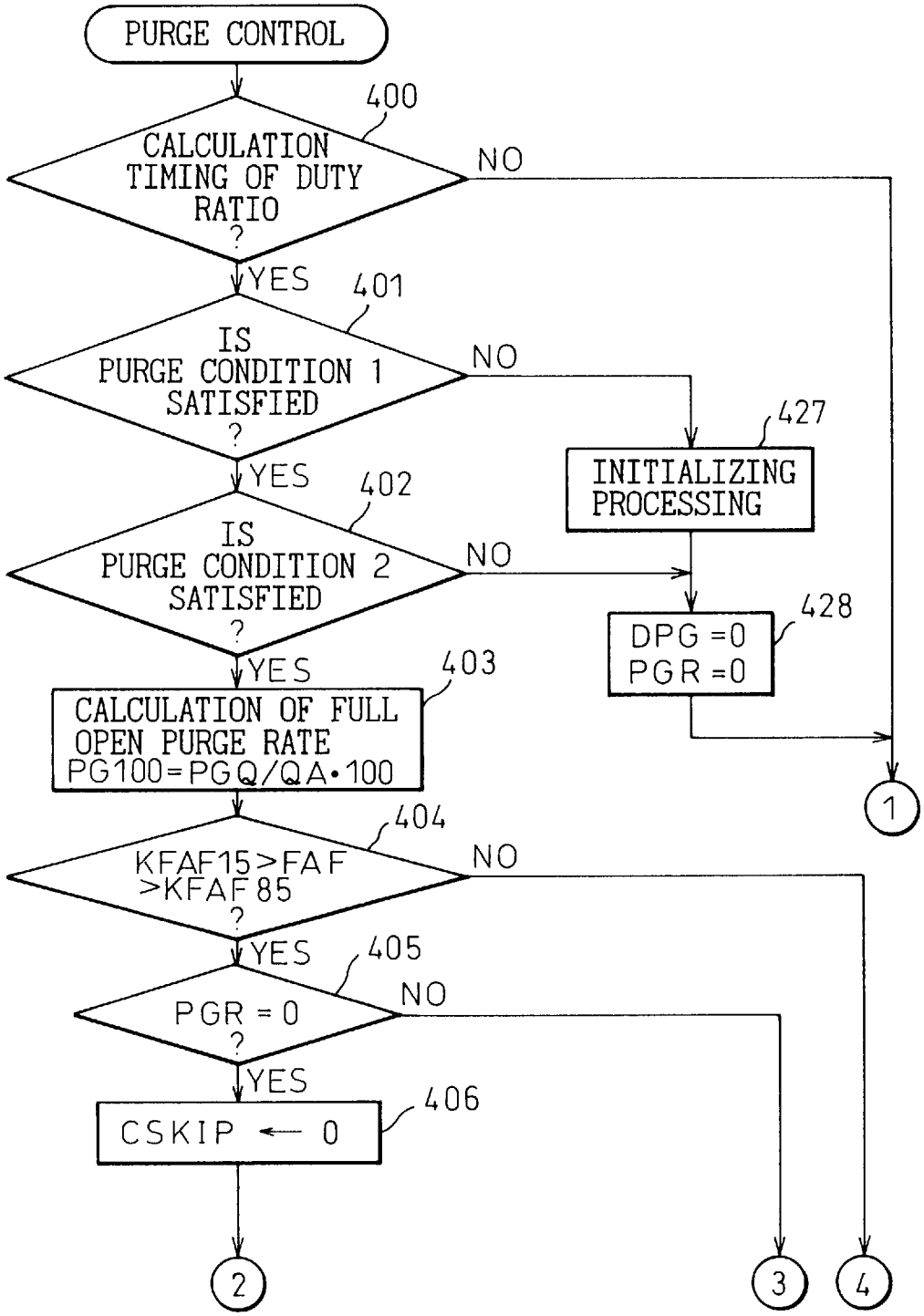
FIGS. 18 to 20 are flow charts of a fourth embodiment for the purge control.
Figure 19:
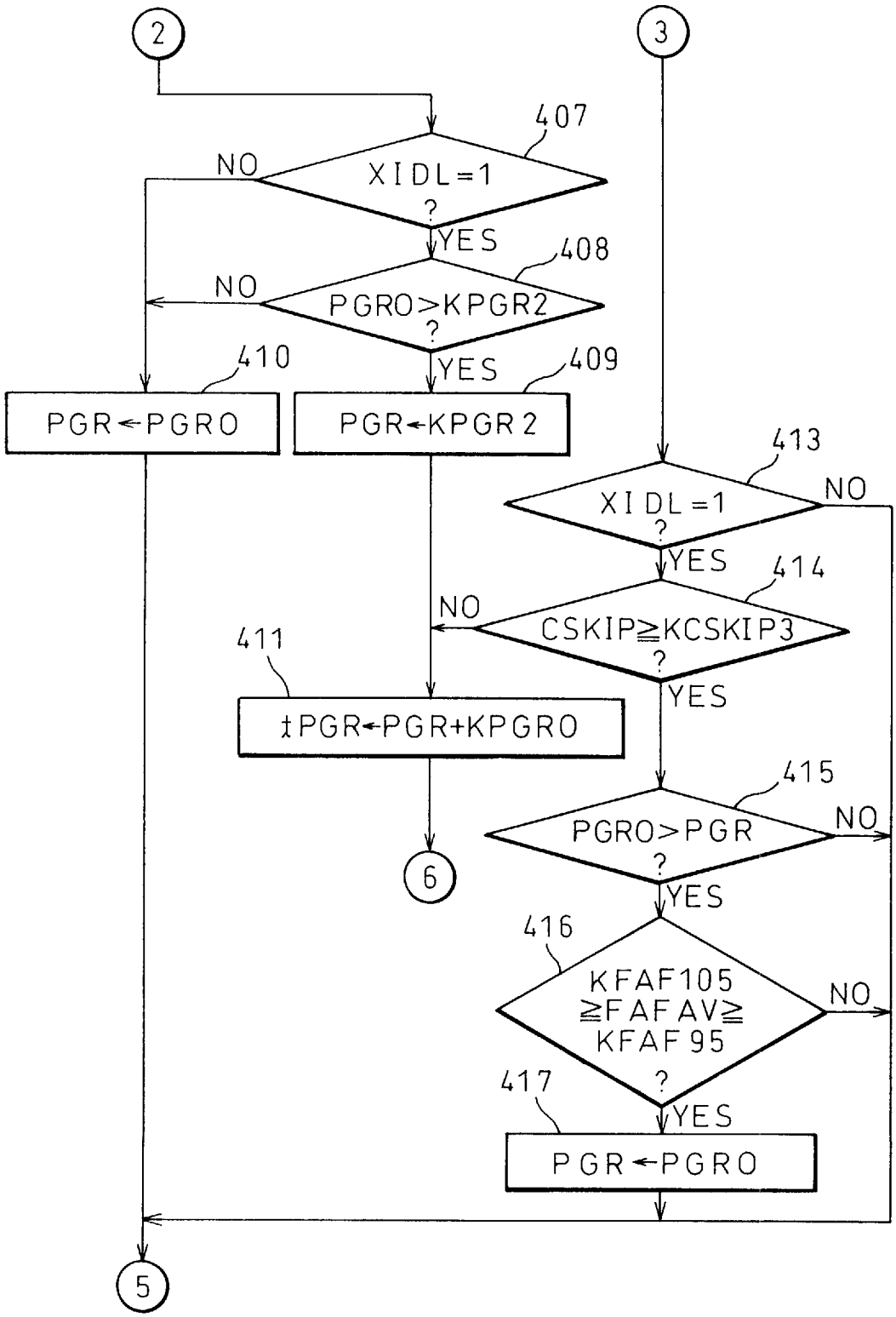
Figure 20:
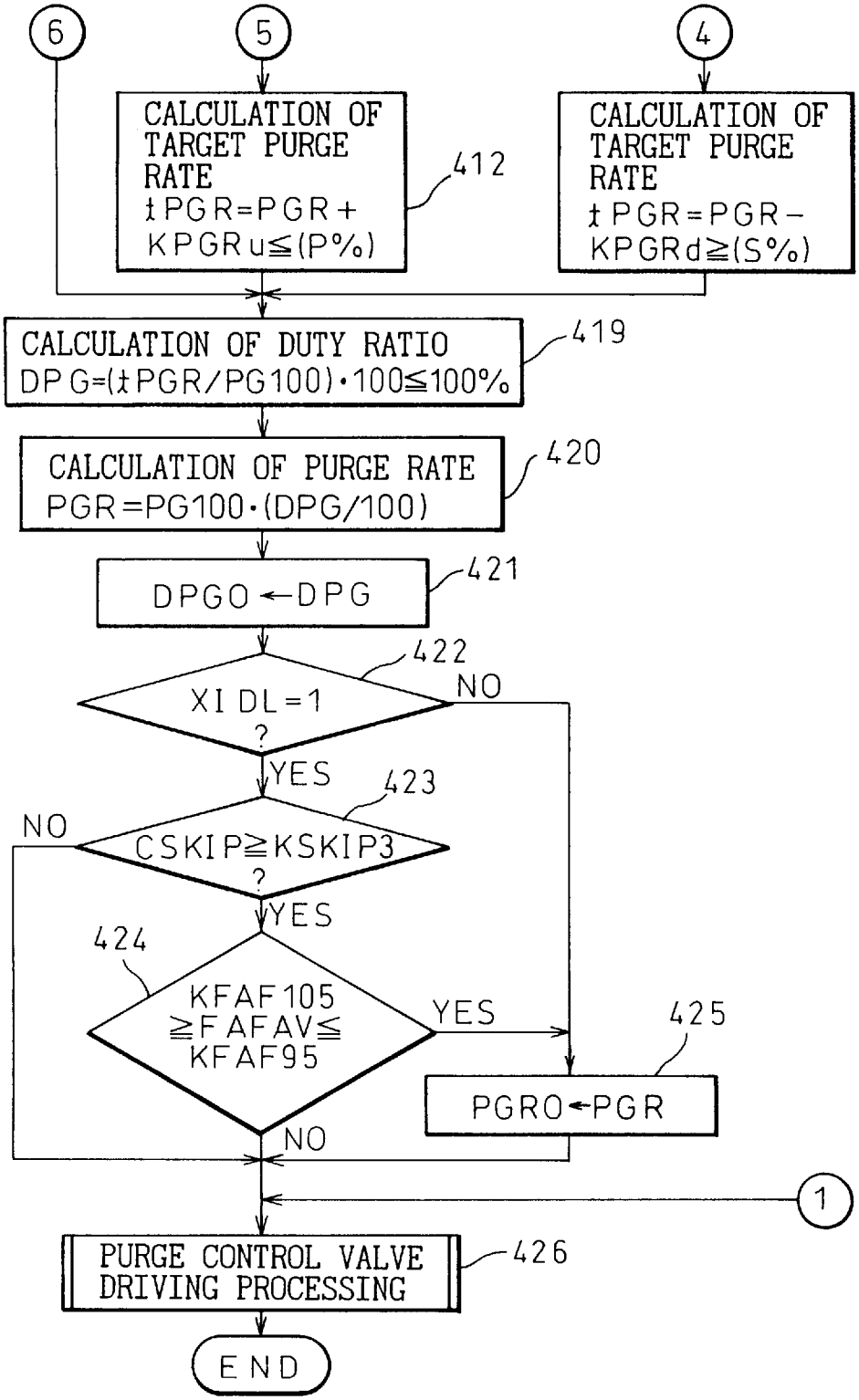

A routine for control of the purge action is shown in FIG. 18 to FIG. 20.

Referring to FIG. 18 to FIG. 20, first, at step 400, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 426, where the processing for driving the purge control valve 17 is executed. As opposed to this, when it is the time for calculation of the duty ratio, the routine proceeds to step 401, where it is judged if the purge condition 1 is satisfied or not, for example, if the engine warmup has been completed or not. When the purge condition 1 is not satisfied, the routine proceeds to step 427, where the initialization processing is performed, then at step 428, the duty ratio DPG and the purge rate PGR are made zero. As opposed to this, when the purge condition 1 is satisfied, the routine proceeds to step 402, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 428, while when the purge condition 2 is satisfied, the routine proceeds to step 403.

At step 403, the ratio between the full open purge amount PGQ and the amount QA of intake air, that is, the full open purge rate PG100 (=(PGQ/QA)·100) is calculated. Next, at step 404, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 405, where it is judged whether the purge rate PGR is zero or not. When PGR=0, that is, when the purge action is not being performed, the routine proceeds to step 406. At step 406, the count CSKIP of the number of skips of the feedback correction coefficient FAF is made zero, then the routine proceeds to step 407.

At step 407, it is judged if the idling flag XIDL, which is set when the engine operating state is an idling state, has been set or not. When the idling flag XIDL is reset (XIDL=0), that is, when the engine is not idling, the routine proceeds to step 410, where the purge rate PGR0 just before the purge action was stopped is made the restart purge rate PGR. Next, the routine proceeds to step 412.

On the other hand, when it is judged at step 407 that the idling flag XIDL has been set, that is, when the engine is idling, the routine proceeds to step 408, where it is judged if the purge rate PGR0 just before the purge action was stopped is larger than the minimum purge rate KPGR2 or not. When PGR0≦KPGR2, the routine proceeds to step 410, where the purge rate PGR just before the purge action was stopped is made the restart purge rate PGR.

As opposed to this, when it is judged at step 408 that PGR0>KPGR2, the routine proceeds to step 409, where the minimum purge rate KPGR2 is made the restart purge rate PGR, then the routine proceeds to step 411. That is, even when the purge rate PGR0 just before the purge action was stopped is larger than the minimum purge rate KPGR2, when the purge action is started while the engine is idling, the minimum purge rate KPGR2 is made the restart purge rate PGR.

At step 411, the target purge rate tPGR (=PGR+KPRGu) is calculated by adding a set value KPGR0 to the purge rate PGR, then the routine proceeds to step 419. This set value KPGR0 is smaller than the set value KPGRu used for calculation of the target purge rate tPGR at step 312, therefore at step 411, while the target purge rate tPGR is being calculated, the rate of increase of the target purge rate tPGR is slowed.

On the other hand, when it is judged at step 405 that the purge rate PGR is not zero, that is, when the purge action is not being performed, the routine proceeds to step 413, where it is judged if the idling flag XIDL has been set or not. When the idling flag XIDL has been reset, that is, when the engine is not idling, the routine jumps to step 412. As opposed to this, when the idling flag XIDL has been set, that is, when the engine is idling, the routine proceeds to step 414.

At step 414, it is judged if the count CSKIP of the skips is larger than a set number KCSKIP3, for example, three, or not. That is, it is judged if the number of skips of the feedback correction coefficient FAF has exceeded three or not. When CSKIP<KCSKIP3, the routine jumps to step 411. Therefore, until the feedback correction coefficient FAF is skipped three times after restart of a purge action, the target purge rate tPGR is raised at a low speed.

Next, when CSKIP≧KCSKIP3, the routine proceeds to step 415, where it is judged if the purge rate PGR0 just before the purge action was stopped is larger than a current purge rate PGR. When PGR0≦PGR, the routine jumps to step 412. As opposed to this, when PGR0>PGR, the routine proceeds to step 416, where it is judged if the average value FAFAV of the feedback correction coefficient is between KFAF95 (=0.95) and KFAF105 (=1.05) or not. When FAFAV<KFAF95 or FAFAV>KFAF105, the routine jumps to step 412, while when KFAF105≧FAFAV ≧KFAF95, the routine jumps to step 417, where the purge rate PGR0 just before the purge action was stopped is made the purge rate PGR. Therefore, at this time, the purge rate PGR is increased all at once to the purge rate PGR0. Next, the routine proceeds to step 412.

At step 412, the target purge rate tPGR (=PGR+KPRGu) is calculated by adding a constant value KPGRu to the purge rate PGR. Next, the routine proceeds to step 419. On the other hand, when it is judged at step 404 that FAF≧KFAF15 or FAF≦KFAF85, the routine proceeds to step 418, where the constant value KPGRd is subtracted from the purge rate PGR to calculate the target purge rate tPGR (=PGR−KPGRd). Next, the routine proceeds to step 419.

At step 419, the target purge rate tPGR is divided by the full open purge rate PG100 to calculate the duty ratio DPG (=(tPGR/PG100)·100) of the drive pulse of the purge control valve 17. Next, at step 420, the full open rate PG100 is multiplied by the duty ratio DPG to calculate the actual purge rate PGR (=PG100·(DPG/100)). Next, at step 421, the duty ratio DPG is made DPG0.

Next, at step 422, it is judged if the idling flag XIDL is set or not. When the idling flag XIDL is reset, the routine proceeds to step 425, where the purge rate PGR is made PGR0. As opposed to this, when the idling flag XIDL is set, the routine proceeds to step 423, where it is judged if the count CSKIP of the skips has exceeded the set value KSKIP3 or not. When CSKIP<KSKIP3, the routine proceeds to step 426, while when CSKIP≧KSKIP3, the routine proceeds to step 424.

At step 424, it is judged if the average value FAFAV of the feedback correction coefficient is between KFAF95 (=0.95) and KFAF105 (=1.05) or not. When FAFAV<KFAF95 or FAFAV≧KFAF105, the routine jumps to step 426, while when KFAF105≧FAFAV≧KFAF95, the routine proceeds to step 425.

That is, when the purge action is restarted while the engine is idling, the value of PGR0 is held at the purge rate of just before the purge action was stopped until the number of skips exceeds three and KFAF105≧FAFAV≧KFAF95. At step 417, the purge rate PGR0 of just before the purge action was stopped is made the purge rate PGR, then the routine proceeds from step 424 to step 425. Next, at step 426, processing is performed to drive the purge control valve 17 shown in FIG. 8.

As mentioned above, according to the present invention, it is possible to prevent the air-fuel ratio from fluctuating at the time of restart of a purge action of fuel vapor after the purge action has been stopped once.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of purge of fuel vapor to be purged to the intake passage;

purge control means for restarting the purge of the fuel vapor after the purge of the fuel vapor is stopped once during engine operation; and restart purge rate setting means for restarting the purge action by the purge rate just before the purge action was stopped when a load of the engine at the time of the restart of the purge action is higher than a predetermined set load and restarting the purge action by a purge rate below the predetermined purge rate when the load of the engine at the time of the restart of the purge action is lower than the predetermined set load.

2. An evaporated fuel treatment device as set forth in claim 1, wherein it is judged that the engine load is lower than the set load when the engine operating state is an idling state and it is judged that the engine load is higher than the set load when the engine operating state is a state other than the idling state.

3. An evaporated fuel treatment device as set forth in claim 1, wherein the predetermined purge rate is a constant value.

4. An evaporated fuel treatment device as set forth in claim 1, wherein said restart purge rate setting means restarts the purge action by said predetermined purge rate when the purge rate of just before the purge action was stopped is higher than said predetermined purge rate and the engine load at the time of restart of the purge action is lower than the predetermined load and said restart purge rate setting means restarts the purge action by the purge rate of just before the purge action was stopped when the purge rate of just before the purge action was stopped is lower than said predetermined purge rate and the engine load at the time of restart of the purge action is lower than the predetermined load.

5. An evaporated fuel treatment device as set forth in claim 1, wherein purge rate control means is provided for controlling the amount of opening of the purge control valve so as to control the purge rate and wherein said purge rate control means gradually increases the purge rate toward a predetermined target purge rate.

6. An evaporated fuel treatment device as set forth in claim 1, wherein said predetermined purge rate is determined based on at least one of the amount of intake air and the engine load at the time of restart of the purge action.

7. An evaporated fuel treatment device as set forth in claim 6, wherein the predetermined purge rate is reduced along with a reduction in the engine load.

8. An evaporated fuel treatment device as set forth in claim 1, wherein the predetermined purge rate is determined based on the time of execution of the purge action after the start of engine operation.

9. An evaporated fuel treatment device as set forth in claim 8, wherein the predetermined purge rate is reduced when said time of execution is long compared to when said time of execution is short.

10. An evaporated fuel treatment device as set forth in claim 1, wherein purge rate control means is provided for controlling the amount of opening of the purge control valve so as to control the purge rate, said purge rate control means gradually increases the purge rate toward a predetermined target purge rate by a predetermined rate of increase after the restart of the purge action, and the predetermined rate of increase is slowed when the engine load at the time of the restart of the purge action is lower than said set load compared to when the engine load at the time of the restart of the purge action is higher than said set load.

11. An evaporated fuel treatment device as set forth in claim 1, wherein purge rate control means is provided for controlling the amount of opening of the purge control valve so as to control the purge rate and wherein said purge rate control means gradually increases the purge rate at first after the restart of the purge action when the engine load at the time of restart of the purge action is lower than said set load, then increases it to the purge rate of just before the purge action stopped when a predetermined time has elapsed.

12. An evaporated fuel treatment device as set forth in claim 11, further comprising air-fuel ratio detecting means for detecting an air-fuel ratio, feedback control means for feedback control of the air-fuel ratio so that the air-fuel ratio becomes a target air-fuel ratio, purge vapor concentration calculating means for calculating a purge vapor concentration based on an amount of fluctuation of the air-fuel ratio, and correcting means for correcting the amount of fuel supplied to the engine by the purge vapor concentration calculated by the purge vapor concentration calculating means, said predetermined time being determined based on the state of feedback control of the air-fuel ratio.

13. An evaporated fuel treatment device as set forth in claim 12, wherein said feedback control means controls the air-fuel ratio to a target air-fuel ratio by correcting the amount of fuel supplied by a feedback correction coefficient which changes in accordance with the air-fuel ratio detected by the air-fuel ratio detecting means, said feedback correction coefficient being changed in a skip fashion in the downward direction when the air-fuel ratio changes from lean to rich, said feedback correction coefficient being changed in a skip fashion in an upward direction when the air-fuel ratio changes from rich to lean, and further it is judged that the predetermined time has elapsed when the skip change of the feedback correction coefficient occurs a predetermined number of times after the restart of the purge action.

14. An evaporated fuel treatment device as set forth in claim 12, wherein said feedback control means controls the air-fuel ratio to a target air-fuel ratio by correcting the amount of fuel supplied by a feedback correction coefficient which changes in accordance with the air-fuel ratio detected by the air-fuel ratio detecting means, said feedback correction coefficient fluctuating about a predetermined reference value when the air-fuel ratio is held at the target air-fuel ratio, and it being judged that the predetermined time has elapsed when the feedback correction coefficient has returned to a certain range including a reference value after the restart of the purge action.

15. An evaporated fuel treatment device as set forth in claim 12, wherein said feedback control means controls the air-fuel ratio to a target air-fuel ratio by correcting the amount of fuel supplied by a feedback correction coefficient which changes in accordance with the air-fuel ratio detected by the air-fuel ratio detecting means, said feedback correction coefficient fluctuating about a predetermined reference value when the air-fuel ratio is held at the target air-fuel ratio, and said purge vapor concentration calculating means increasing the purge vapor concentration when the feedback correction coefficient has become smaller than the reference value and decreasing the purge vapor concentration when the feedback correction coefficient has become larger than the reference value.

16. An evaporated fuel treatment device as set forth in claim 12, wherein said correcting means corrects the amount of fuel supplied so that the amount of fuel supplied is decreased the higher the purge vapor concentration.

17. An evaporated fuel treatment device as set forth in claim 1, wherein calculating means is provided for calculating a target air-fuel ratio and means is provided for finding a full open purge rate for when the purge control rate is fully open and wherein the amount of opening of the purge control valve is calculated by dividing the target purge rate by the full open purge rate.

* * * * *